United States Patent [19]

Tyer, Sr.

[11] 4,032,075

[45] June 28, 1977

[54] MULTI-CHAMBERED SCRUBBER HAVING POLYGONAL CROSS-SECTION

[76] Inventor: Clarence C. Tyer, Sr., 6100 Winding Way, Carmichael, Calif. 95608

[22] Filed: Aug. 16, 1976

[21] Appl. No.: 714,532

[52] U.S. Cl. ..... 241/45; 241/152 R; 241/176; 241/183

[51] Int. Cl.[2] ..... B02C 17/06

[58] Field of Search ..... 241/43, 45, 71, 72, 241/152 R, 176, 177, 178, 182, 183, 284

[56] References Cited

UNITED STATES PATENTS

| | | | |
|---|---|---|---|
| 981,445 | 1/1911 | Martin et al. | 241/43 |
| 1,787,897 | 1/1931 | Durnin | 241/72 |
| 2,284,548 | 5/1942 | Wood | 241/177 |
| 2,661,908 | 12/1953 | Slegten | 241/183 |
| 2,837,289 | 6/1958 | Heckett | 241/183 |
| 3,880,365 | 4/1975 | Eigner | 241/182 |

*Primary Examiner*—Granville Y. Custer, Jr.
*Attorney, Agent, or Firm*—Behr & Woodbridge

[57] ABSTRACT

A multi-chambered scrubber is employed to thoroughly wash gravels or materials bearing heavy precious metals. The apparatus includes a multi-chambered scrubber drum which is supported at an angle by a frame and adapted to be driven by a variable speed drive system. The scrubber drum includes at least two sections each of which has a polygonal shaped, watertight interior chamber. Each of the sections is separated by a retainer ring having an opening therein smaller in area than the area of the next preceeding scrubber chamber. The scrubber sections are interchangeable and may be connected one to the other in any of a variety of combinations as may be dictated by the material being scrubbed. The polygonal shape of the scrubber chambers contributes to a greatly improved washing and disintegrating action on the material being treated. The scrubber apparatus also includes a plurality of removable wear plates which can be replaced as they become worn down and damaged.

18 Claims, 5 Drawing Figures

MULTI-CHAMBERED SCRUBBER HAVING POLYGONAL CROSS-SECTION

BACKGROUND OF THE INVENTION

1. Field of the Invention

This invention relates to a multi-chambered apparatus for scrubbing gravels and substances containing heavy precious metals.

2. Description of the Prior Art

The use of scrubbing units for the purpose of washing and breaking up various materials is known to those of skill in the art. For example, it is known to use scrubbers to wash and liberate the rocks derived from compacted gravel deposits. When scrubbers are used for the extraction of heavy metal they are most frequently combined with a rotating screen or trommel as part of the same unit. Combining the rotating screen with the scrubber as part of the same unit has been done in the past. This invention proves that such a combination is less efficient than running the scrubber and screening units separately and at separate speeds.

There are a variety of devices known in the prior art that will accomplish the function of washing and liberating rocks, clay-bound precious metals and similar materials. Non-rotating devices such as vibrating grizzlys have been used to break up large chunks of uranium ore. Rotating scrubbers are also known in the prior art but their internal structure is almost exclusively circular. Circular scrubbers have been found to be ineffective for the purpose of separating heavy precious metals such as gold from a clay or clay-like matrix. The circular nature of the vast majority of circular type scrubbers is such that the gold bearing clay and gravel merely slides up and down the walls of the rotating apparatus and accordingly very little of the precious metal is separated therefrom. The prior art appears to lack a mechanism which will effectively disintegrate and scrub the gravel and disintegrate the clay and put it into solution, leaving the heavy precious metals behind. In order to overcome some of the disadvantages of the prior art, it was known to add agitator baffles or lifters to the interior of a circular type scrubber. While agitating blades often resulted in greater amounts of clay being dissolved, they were found to be inefficient and also tended to break up the particles of heavy precious metal into smaller pieces thereby making them more difficult to recover.

Part of the present invention comprises the discovery that a scrubber having a polygonal interior produces a superior disintegrating scrubbing and washing action to that obtained by prior art circular type scrubbers. In the circular type of prior art scrubbers the material merely slides around the inside of the apparatus. According to the present invention the materials are churned in such a fashion as to throw the clay or gravel up against the sides of the scrubbing unit. By varying the speed and inclination of the scrubber it is possible to obtain the optimum separation of precious metals from a gravel or clay-like matrix without significant deterioration of the metal particles.

The prior art appears to disclose only two references to scrubber type devices having a polygonal interior. For example, Vanduzen, U.S. Pat. No. 292,075 discloses a "Rumble for Scouring Casings, Washing Ores, etc.", wherein the cylinder is "of polygonal or angular form . . . in this instance an octagon". It was further noted that the Vanduzen reference discloses that the device is adapted for use with "precious metals"but it is not clear whether the Vanduzen reference contemplated the use of such a device in the context of precious metal bearing placer material composed of clays or gravels. In addition, the Vanduzen reference also appears to teach the use of "heavy balls" in order to improve the action of the rumble and further discloses the technique of grinding in the context of washing in that a tub is provided in which the polygonal cylinder revolves.

Harris, U.S. Pat. No. 3,730,442 is also noted in that it discloses a grinding apparatus having an octagonal shape.

Smith, U.S. Pat. Nos. 764,870, 894,174 and Jain, U.S. Pat. No. 2,137,051 all disclose gold and silver agitators of the sort associated with cyanide gold extraction process. Those references appear to be relevant only insofar as they disclose the desirability of agitation in processes directed toward the extraction of gold.

Moore, U.S. Pat. No. 706,334 is of general interest in that it discloses an apparatus for leaching ores which provides for the use of grinding balls in a manner generally known to those of skill in the art.

While the prior art does appear to include two disclosures directed toward scrubber type devices having a polygonal cross-section, such devices are not known to have been used, nor has their value been recognized for use on precious metals found in placer materials containing gravel or clay or clay-like matrix. Moreover, the polygonal type scrubbers disclosed by the prior art appears to be very crude and inefficient for the purpose of assisting in the removal of heavy precious metal. It was in the context of these and other disadvantages of the prior art that the present invention arose.

SUMMARY OF THE INVENTION

Briefly described, the present invention comprises a multi-chambered scrubber having a polygonal cross-section especially adapted for the removal of heavy precious metals from gravels or materials containing a clay or clay-like matrix. The scrubber is very efficient at dissolving the clay matrix without significantly breaking up the particles of heavy precious metals that may be entrapped therein. According to the preferred embodiment the entire scrubber apparatus comprises a frame, a drive system and a scrubber drum supported by the frame and adapted to be driven by the drive system. The scrubber drum includes a material input port, at least two scrubber sections and a material output port. The exterior of the scrubber sections is circular but the interior scrubber chambers are polygonal in cross-section. Each section is separated from the other by a retainer ring having a circular interior opening which is preferably smaller in area than the cross-sectional area of the polygonal interior of the preceding up-stream scrubber section. In the preferred mode the hardest scrubbing takes place in the first section and the degree of harshness diminishes as the material progresses down the interior of the scrubber drum. Accordingly the cross-section of the interior of the first scrubber section might be a lower order polygon such as a triangle or a square and the subsequent down-stream sections will include scrubber chambers with a cross-section of a higher order polygon such as pentagons, octagons, etc. In this same manner the circular opening in the retainer ring dividing the sections progressively becomes larger toward the down-stream end of the scrubber. The apparatus is adapted so that sections as well as the entire apparatus can be driven at variable speeds and at a variable inclination so that the optimum action upon the materials may be obtained.

It has been found that a plurality of scrubbing sections connected together in the manner just described produces a very superior separation of heavy metals from gravels or other materials containing a clay or clay-like matrix. The present invention is also an improvement over the prior art in that it provides for removable interior wear plates which may be quickly replaced if damaged or worn out.

The preferred mode of the invention discloses a device wherein the action imposed upon the material being processed becomes progressively less severe as that material goes down-stream. However, in some applications it may be desirable to provide for harsher action down-stream rather than up-stream. Since all of the scrubber sections are separable and interchangeable, a less severe section can be placed first and a more severe section later on. The ability of the user of the scrubber to change scrubber sections to fit the requirements of the material being treated greatly adds to the efficiency of the overall device. In addition, while the preferred embodiment of the present invention is directed toward the use of the device in the context of the separation of heavy precious metals from gravel or other materials containing a clay or clay-like matrix, it will be appreciated that there are other applications for this invention including, but not limited to, the scrubbing of all earth materials.

These and other features of the present invention will be more fully understood with reference to the following drawings.

DETAILED DESCRIPTION OF THE INVENTION

During the course of the following description like numbers will be used to designate like elements according to the different figures showing the apparatus.

Figure 1:
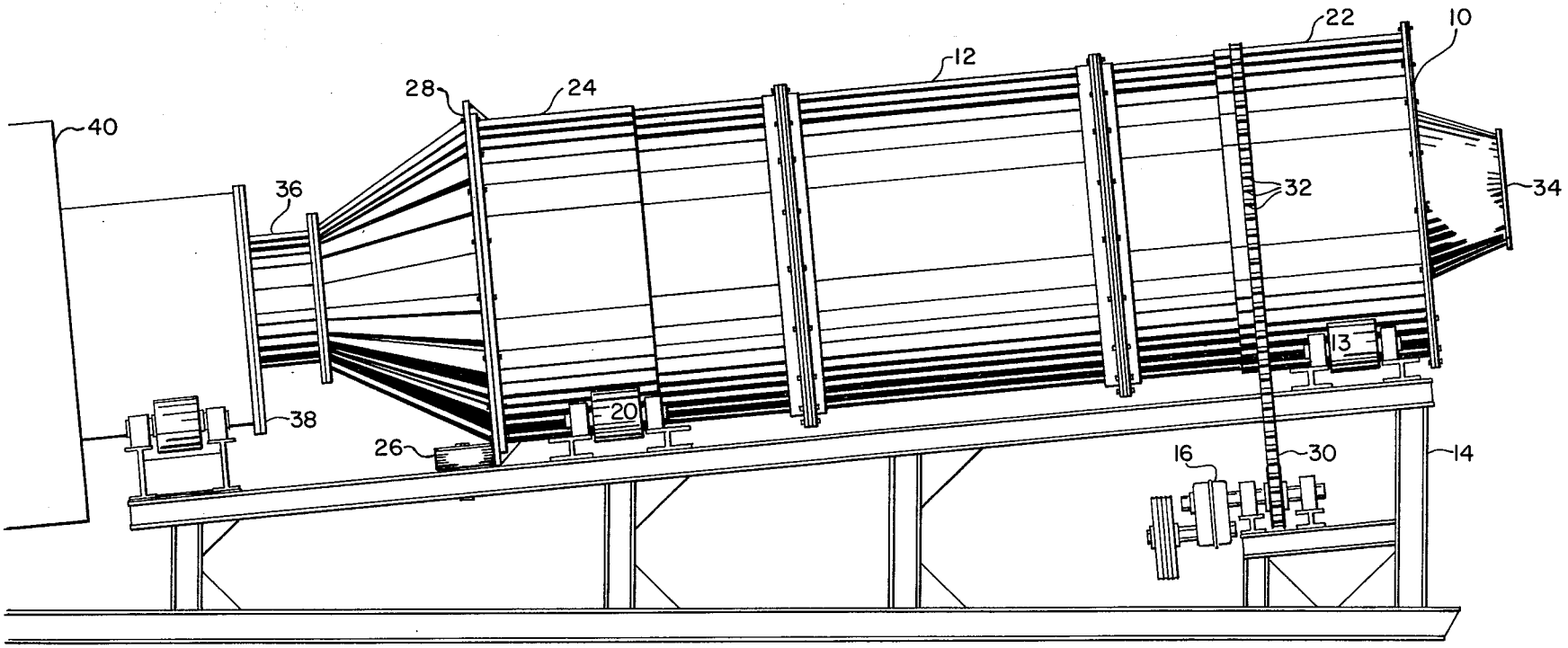
FIG. 1 is an elevational view of the present invention according to a preferred embodiment thereof as seen from the side.

As illustrated in FIG. 1 the scrubber apparatus 10 according to a preferred embodiment of the present invention comprises a multi-chambered scrubber drum 12, an inclined frame 14 and a variable speed drive 16. The frame 14 supports the scrubber drum 12 by means of a set of roller bearings 13 and 20 located at the upper and lower end of the drum 12. The roller bearings 13 and 20 are adapted to make contact with built-up annular collars 22 and 24 which are sufficiently strong to take the load. A thrust absorbing roller 26 is adapted to make contact with collar flange 28 located at the lowest end of the scrubber drum 12. Roller 26 and flange 28, and rollers 13 and 20 and their associated collars 24 and 24, respectively are adapted to the scrubber drum 12 in such a fashion that allows it to rotate as driven by variable speed drive 16. The use of such a roller and collar system is believed to be conventional and known to those of skill in the art.

The drive system 16 may be attached to a prime mover (not illustrated) in a manner known to those of ordinary skill in the art. The drive system 16 is connected to a drive chain 30 which is adapted to engage gear teeth 32 located around the periphery of collar 22. The rotary motion of a prime mover such as a gasoline or electric motor is transmitted through the drive system 16 and drive chain 30 to the drum 12 thereby causing it to rotate on rollers 13, 20 and 26. According to the preferred embodiment of the present invention the drive system is preferably adapted to rotate the scrubber drum at a speed of between 20 and 35 r.p.m. The frame 14 is adapted to be inclined at a slope of between ¾ to 2 feet per foot. The frame itself may be made adjustable or it can be positioned upward or downward by a shim or by other devices known to those of skill in the art.

The scrubber drum 12 includes a material input port 34 and a material output port 36. The output port 36 is adapted to feed into the input port 38 of a trommel or screening unit 40. Trommels are well known to those of skill in the art as a means for classifying heavy metals such as gold which may be treated by the scrubber apparatus 10. Since trommels are well known to those of ordinary skill in the art the details of trommel unit 40 do not need further explanation. However, the present invention does comprehend the use of a trommel which is adapted to be driven at a speed which is independent of the speed of a scrubber drum 12. For example it has been found that speeds of approximately 10 r.p.m. are effective for classifying heavy precious metals but that scrubber drum speeds of at least twice that are necessary to efficiently separate the precious metals from material bearing gravel or a clay or clay-like matrix. It is an important feature of the present invention that the scrubber drum 12 be adapted to be driven at a speed different from and preferably greater than the speed of the trommel unit 40. Since the apparatus and methods of driving a trommel drum are well known they are not illustrated in the present invention.

Figure 2:
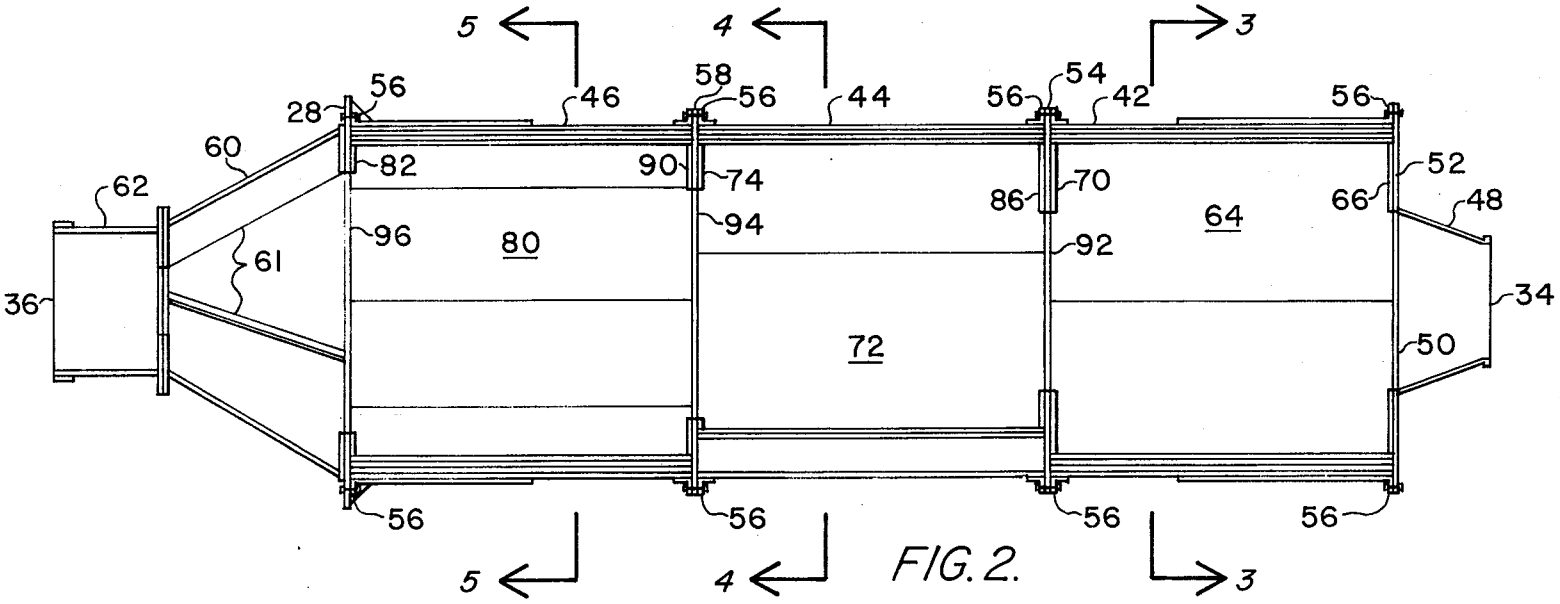
FIG. 2 is a cross-sectional view of the scrubber drum illustrated in FIG. 1.

As shown in FIG. 2, the scrubber drum 12 includes a first, second and third scrubber section illustrated as elements 42, 44 and 46 respectively. Material enters the first scrubbing section from material input port 34 and through a conical front section 48. The top of the conical section 48 is approximately 24 feet in diameter at the input port and approximately 36 feet in diameter at the base 50 thereof. A circular plate 52 connects the conical input section 48 to the exterior shell of the first scrubber section 42. Plate 52 may be connected to the shell of the first section either by bolts or by welding or by a combination of both in a manner known to those of skill in the art.

First scrubber section 42 is separated from second scrubber section 44 by means of a first circular retainer ring 54. Scrubber sections 42, 44, and 46 are all equipped with circular flanges 56. The retainer ring 54 and the flanges 56 are constructed with holes therein which will receive a locking bolt. Accordingly, the first scrubber section 42 is connected to the second scrubber section 44 by aligning the holes in retaining ring 54 with the corresponding holes in flanges 56 and then passing a locking bolt therethrough. In a similar manner the second scrubber section 44 is separated from the third scrubber section 46 by means of a second retainer ring 58. The other end of the third scrubber section 46 is connected to the round circular thrust absorbing flange 28 previously described. The flange 28 is reinforced in such a fashion as to absorb the weight of the scrubber section. An inverse conical funnel-like section 60 connects the rear flange 28 with a discharge cylinder 62 which fits in the mouth of a trommel unit in the manner described with reference to FIG. 1. The material output port 36 comprises one end of discharge cylinder 62. Three helical blades 61 help to move material from scrubber section 80 to output port 36.

Figure 3:
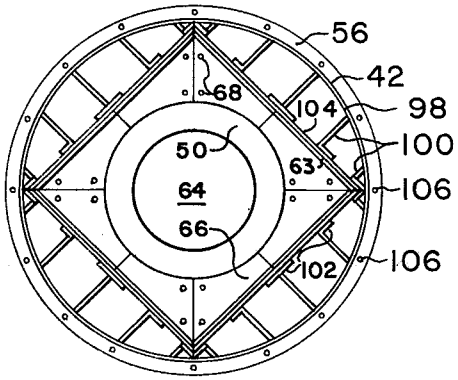
FIG. 3 is a cross-sectional view of the first scrubber section of the scrubber drum as seen from perspective 3—3.

FIG. 3 is a cross-sectional view of the first scrubber section 42. The interior of scrubber section 42 comprises a square scrubber chamber 64. A plurality of front end hold down or holding plates 66 are shown from the interior to be connected by a plurality of bolts 68 to exterior front plate 52. Holding plates 66 are adapted to secure movable wear plates 63 in position at one end of the scrubber chamber 64. The other end of the wear plates 63 are secured at the down-stream end of chamber 64 by a set of retainer ring holding plates 70. In a similar fashion the retainer ring holding plates 70 are bolted to retainer ring 54.

Figure 4:
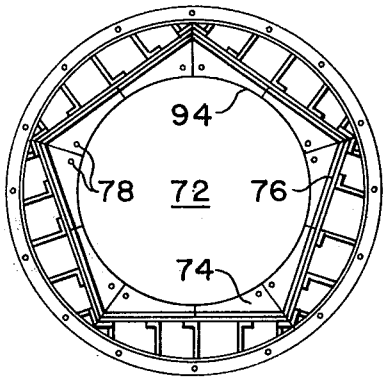
FIG. 4 is a cross-sectional view of the second section of the scrubber drum as seen from perspective 4—4.

The second scrubber section 44 is shown in cross-sectional detail in FIG. 4 to include a scrubber chamber 72 having a polygonal shape. Another set of retainer ring holding plates hold the down-stream side of the removable wear plates 76 in place. In a manner similar to that previously described a plurality of bolts 78 is employed to attach the retainer ring holding plate 74 to retainer ring 58. The up-stream end of the wear plates 76 are held in place by retainer ring holding plates 86 as illustrated in FIG. 2.

Figure 5:
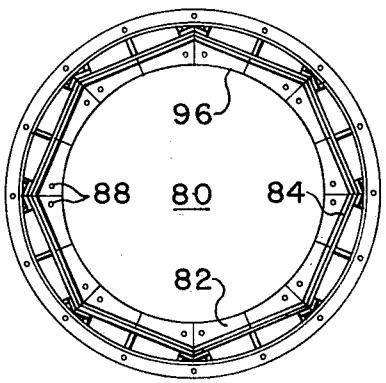
FIG. 5 is a cross-sectional view of the third section of the scrubber drum as seen from perspective 5—5.

Likewise, FIG. 5 illustrates a cross-sectional view of the interior octagon shaped scrubber chamber 80 of the third scrubber section 46. In a manner similar to that previously described the retainer ring holding plate 82 secures the down-stream end of removable wear plates 84 to the inside of the chamber. A plurality of bolts 88 are illustrated as being the preferred means of connecting the retainer ring holding plates to flange 28. The up-stream end of removable wear plates 84 is connected to the retainer ring 58 by means of another set of retainer ring holding plates 90 as shown in FIG. 2.

It will be noted from FIGS. 3 through 5 that each side of the scrubber chambers 64, 72 and 80 include removable wear plates 63, 76 and 84 respectively. The wear plates are preferably split in two so as to make them easier to handle and to make sure that they will pass through material input port 34 and through the openings in retainer rings 54 and 58. It is desirable to have removable wear plates because the interior of the scrubber drum 12 is subjected to tremendous disintegrative force as it breaks up the material on the inside. According to the preferred embodiments the wear plates would range between ½ to ¾ in thickness.

As graphically illustrated in FIG. 2, the opening in the retainer rings 54 and 58 becomes progressively larger as the material moves from the input port to the output port. Thrust bearing flange 28 also acts as a retainer ring. In practice the annular opening 92 in retainer ring 54 would be approximately 36 in diameter. Annular opening 94 would in turn be larger and be of the order of 48. Likewise, the annular opening 96 in the circular thrust bearing flange 28 would be even still larger and of the order of approximately 57. Therefore, according to the preferred embodiment of the openings 92, 94 and 96 become progressively larger as material moves further down-stream. The retainer rings are important because they help to slow up the progress of the material as it flows through the scrubber drum. The smaller annular opening 92 is necessitated near the first scrubber section 42 since the materials to be scrubbed in that section are likely to be larger than materials which find their way down-stream. As the material is broken up a smaller and smaller barrier is necessary to keep the material from running out of the scrubber unit. In a similar manner it will be noted that the cross-section of the scrubber chambers progress from a lower order polygonal figure toward a higher order polygonal figure. Specifically, the interior of the scrubber chambers 64, 72 and 80 progress from a square to a pentagon to an octagon respectively. The most severe disintegration and scrubbing action takes place in the first square section. An intermediate scrubbing action is obtained in the second scrubbing chamber 72 and the least severe scrubbing action is found in scrubber chamber 80.

The construction of the drum is relatively rugged and uncomplicated. As shown in FIG. 3, the exterior of the first section 42 includes a cylindrical shell 98 to which circular flange 56 is attached. Welded to shell 98 are a plurality of stiffening or strengthening members 100 which radiate inwardly. The end of the stiffening member 100 not connected to shell 98 is terminated by the flat head section 102. In turn the flat head section 102 is adapted to support permanent interior plates 104. Plates 104 are welded one to another in a water-tight fashion so that no fluids seep into the space between permanent plates 104 and the outer shell 98. The removable wear plates 63 are adapted to lie flat against permanent plate 104 and are held in place by front holding plate 66 and retainer ring holding plate 70 in a manner previously described. The construction of the second section 44 and the third section 46 is similar in nature to that described with reference to the first section 42 as can be seen from FIGS. 4 and 5.

In operation, the scrubber drum is charged with material through the input material port 34 and is received in the first scrubber chamber 64. There it is subjected to a very severe scrubbing action. The action can be described as a churning action in which the material is thrown from one wear plate toward the other. In the process of being thrown the material either collides with another wear plate or with other material in the interior of the scrubbing chamber 64. It has been found helpful to include large chunks of material to facilitate the grinding action of the device. During the scrubbing process water is continuously introduced through the input port 34 to accompany the materials. In the preferred embodiment the scrubber drum 12 is used to disintegrate gravel, clay or clay-like materials which may contain placer gold or other heavy minerals. When the operation takes place efficiently the bulk of the gravel or clay is disintegrated and put into a water solution. At the same time the particles of placer gold and other heavy minerals are set free from the gravel or clay matrix so that they can be screened through the trommel unit and recovered from other apparatuses down-stream. As described previously it has been found that scrubbers having a circular interior are not efficient. Care must be taken that the scrubbing action is not so severe as to break up the gold and other heavy mineral particles and thereby make it more difficult to recover them later on.

As more material enters the first scrubber chamber 64 other material will be forced out into second scrubber chamber 72. In chamber 72 the material will be subjected to a slightly less severe action which facilitates the breaking up of smaller aggregates of gravel, clay or clay-like material. Likewise as scrubber chamber 72 fills up, material will spill over into scrubber chamber 80 which is adapted to break up the finer material. Once the material has been scrubbed it passes out through output port 36 assisted by helical lifter blades 61 into trommel unit 40 in a manner previously described.

Even though the invention has been described with reference to a preferred embodiment thereof, it will be appreciated by those of skill in the art that the general inventive concept has broader application than the particular embodiment described. For example, one of the important features of the invention is the fact that the scrubber sections are interchangeable and may be mixed in any order that produces the action desired. The feature of interchangeability is important because the scrubber apparatus may be moved from one location to another where the material to be treated is considerably different. For example, if the material to be treated consists mostly of a sandy material then the violent action of the first scrubber section 42 may be unnecessary and that scrubber section might be removed. It is contemplated that from 1 up to 5 scrubber sections might be employed in any one given scrubber drum 12. It is also possible that all of the scrubber chambers will have the same polygonal cross section. For example, they could all be squares or pentagons or octagons or any other desired shape. In the minimum case the scrubber section might include a three-sided scrubber chamber in the shape of a triangle. In the maximum case a higher order polygon may be desired. However, it is probably not desirable to employ a scrubber chamber with too many sides since the action therein will approach the action that is found in conventional circular scrubbers. Generally, the scrubber chambers whose cross-sections are lower order polygonal figures will have the more severe scrubbing action. Severe scrubbing action would therefore be associated with triangular or square cross-sections. Conversely, the less severe scrubbing action would take place in the scrubber chambers whose cross-sections are of higher order polygon.

The foregoing invention is very versatile in that it can be adapted for many different types of scrubber applications. Prior art devices were generally broad spectrum mechanisms designed with only one type of configuration. The present invention can be made extremely efficient to process a large variety of different earth materials. The increased efficiency with a wide variety of earth materials is attributed principally to the following features.

1. The interchangeability of the scrubber sections to meet the particular needs of the materials to be processed;

2. The ability to add as many scrubber sections as necessary;

3. The ability to choose a scrubber chamber whose internal profile gives the best scrubbing action;

4. The ability to vary the speed of the drum or the speed of separate sections to achieve the maximum scrubbing efficiencies. According to one embodiment of the invention the speed of the separate drum sections may be varied, providing that the drum sections are not rigidly attached one to another and that a separate drive mechanism is provided for each independently rotatable unit and,

5. The ability to tilt the drum to the most efficient angle of inclination.

The retainer rings located between adjacent scrubber sections are intended to prevent the material from flowing through the scrubber drum to fast. The diameter of the internal opening in the retainer ring is proportional to the size of the material being processed. Generally a smaller opening is associated with materials of larger size so as to prevent them from rolling through the drum too fast. Since the materials are progressively broken up as they pass through the drums the opening in the retainer ring correspondingly becomes larger toward the down-stream end of the apparatus.

The scrubber drum is constructed in a special manner so as to be especially strong yet relatively light. Great internal strength is essential since large rocks and the like are being churned by the internal wear plates. The special throwing action of the scrubber chambers produce a great deal of pounding and impact upon the internal wear plates. This impact must be absorbed in such a fashion as to evenly spread the forces thereof around the drum. As previously discussed with respect to FIG. 3 the stiffening members 100 radiate inwardly from the outer shell 98 of the first scrubber section 42. The head portion 102 of the stiffening members 100 is flattened out at right angles to support permanent interior plates 104. Since stiffeners 100 are perpendicular to the permanent internal plates and therefore perpendicular to the wear plates the impact upon the wear plates is directly transmitted to the outer shell of the scrubber sections. This particular type of construction is very strong yet relatively light. Lightness is important since a great deal of energy is required to rotate the scrubber drum 12 and the heavier the construction of the drum the more energy and more expense required to rotate the device. The strong but relatively light weight construction of the apparatus contributes to greater economy and efficiencies.

The space between the permanent interior plates 104 and the exterior shell 98 as illustrated in FIG. 3 with reference to the first scrubber section 42 is not only water tight but air tight as well. It is highly desirable that the dead space be water tight since water would tend to corrode the device and would also add to the weight of the drum. Accordingly, the seams on the interior are welded so as to be impervious to water.

Because the interior of the scrubber drum 12 is subjected to continual severe impact it is important that the construction materials of the scrubber chambers be able to stand up to that abuse. In order to decrease unnecessary down time the wear plates and the holding plates are constructed of high carbon abrasion resistant ("AR") steel. As previously described the thickness of the steel typically ranges from between ½ inch to ¾ inch but may be any desired thickness according to the materials being scrubbed.

Since the wear plates are very heavy and because they have to be replaced periodically, it was found desirable to split them to make them more manageable. Therefore, as previously described, two wear plates are generally used on each side of the polygonal scrubber chambers. The splitting of the wear plates is dictated not only by reasons of weight but also by the fact it may be necessary to replace the wear plates by pushing them through the material input port 34 or through the output port 36. According to the preferred embodiment of the invention the input port 34 has a minimum opening of 24 inches and therefore will only accept wear plates having a width of 24 inches or less. In order to replace a worn or damaged wear plate a mechanic can enter the scrubber drum 12 either through input port 34 or output port 36 and remove the damaged wear plate by unbolting the holding plates associated with both ends thereof. The damaged wear plate is then removed from the scrubber drum 12 and a new wear plate is then brought in and secured to the scrubber chamber by bolting the holding plates into position in the manner previously described. Because of this construction the worn wear plates can be removed and replaced by new wear plates in a very short period of time. The wear plates are held in a securely locked position by the holding plates. In a small apparatus which can process approximately 100 tons of material per hour, the preferred embodiment of the drum itself would be approximately 6 ft. in diameter and each scrubber section is approximately 6 ft. long. Therefore the wear plates are approximately 6 ft. long too. Since the wear plates and the holder plates are all constructed of replaceable abrasion resistant steel, the apparatus can process a large volume of material before replacement of the internal plates is necessary. Another very important feature of the present invention is the fact that the scrubber chambers can be independently oriented with respect to one another. For example, if all of the scrubber chambers were square, it would be highly undesirable for them to be in the same identical relative orientation since each of the chambers would be lifting and throwing at the same point in the machine cycle. Lifting occurs in the V-shaped pockets between wear plates. If three square scrubber chambers lift at the same moment, then a very heavy load is placed on the drive mechanism 16 and the drive chain 30 every 90° of rotation. Accordingly, it is desirable to orient each chamber so that each scrubber chamber does not lift at the same time. By so doing the instantaneous energy requirements and the stress on the equipment is greatly reduced. Given the example of three square scrubbing chambers it would be desirable that the V-shaped lifting portions of each of the chambers be 30° out of phase with the other two chambers. In this manner, twelve small lifting loads are incurred for every 360° of rotation as opposed to four large lifting loads. The same principle can be applied to a plurality of connected scrubber chambers having different cross-sectional sectional configurations. It will be noted, for example, with reference to the relative orientations of scrubber chambers 64, 72 and 80 of FIGS. 2 – 5 that an effort has been made to make sure that the alignment of the V-shaped lifting sections do not coincide. In general, the larger the number of sides to the polygon, the less energy it requires to lift materials. Therefore, scrubber chambers having a triangular or square shaped cross-section consume a greater amount of energy than scrubber chambers having cross-sections of higher order polygons. The scrubber chambers can be reoriented by turning them and placing bolts through the bolt receiving holes 106 in flanges 56. As shown in FIGS. 3 through 5, there are sixteen bolt receiving holes 106 located around the periphery of flange 56. Accordingly, each hole is located 22 ½° apart and therefore each section can be turned in increments of 22 ½° with respect to any other section. Of course, the holes 106 can also be located at other intervals such as 15° or 30°, etc. By staggering the orientation of the scrubbing chambers it is possible to reduce the energy consumed by the scrubber unit. Prior art scrubber devices frequently consumed considerable energy because they included internal lifters or fins which carried material around the periphery of the interior of the scrubber unit. It has been found that the present polygonal, finless structure is less energy consuming than prior art scrubbers. The staggering of the scrubber sections provides generally smoother running operation for the scrubber as a whole.

The preferred embodiment of a small capacity apparatus can process approximately 75 – 150 tons of material an hour. At the same time the apparatus consumes between 1,000 and 2,000 gallons per minutes of continuous water depending upon the type of material being washed. A larger scrubber based upon the teachings herein could be built with a capacity of 1,000 tons per hour or more. In general, the capacity of the scrubber is a function of its size and the larger the size of the scrubber the greater the capacity. As the special action of the scrubber chamber breaks up the materials the water quickly places the lighter portions thereof into solution. The action imparted to the materials is similar to a throwing movement.

As previously discussed the material inside the scrubber is thrown in a tight circle and caused to collide both with the walls of the scrubber chamber and with other pieces of material. The material is typically not thrown across the total width of the unit. The action is very much like a rolling ocean wave which continually turns over at a fast rate.

The apparatus just described is very versatile and may be adapted to a wide variety of gravels or materials bearing heavy precious metals. The interchangeability of the scrubber sections not only allows the user to achieve the optimum scrubbing action for the material being treated but also allows for easy dis-assembly of the scrubber drum 12 so that it may be moved to another location and subsequently reassembled. It will be appreciated by those of skill in the art that other terms may be used to describe the various elements of the scrubber apparatus. For example the scrubber drum may also be referred to as a barrel or the holding plates may be referred to as hold down plates or the like. The language used herein is not meant to be limitive of the inventive concepts disclosed.

While the invention has been particularly shown and described with reference to the preferred embodiment thereof, it will be understood by those skilled in the art that various changes in form and detail may be made therein without departing from the spirit and scope of the invention.

I claim:

1. A multi-chambered scrubber apparatus comprising:

a frame;

a drive means; and;

a scrubber drum supported by said frame and adapted to be rotated by said drive means, said scrubber drum having a material input port and an output port and including between said input and output ports at least a first and second scrubber section each having a first and a second interior polygonal scrubber chamber, said first and second polygonal scrubber chambers including a first retainer ring therebetween having an opening therein smaller in area than the cross-sectional area of said first polygonal scrubber chamber.

2. The apparatus of claim 1 further including:

a plurality of removable wear plates; and, a plurality of retainer ring holding plates attached to said retainer ring for holding said wear plates against the interior of said scrubber chambers.

3. The apparatus of claim 2 wherein said scrubber drum is inclined at a slope ranging between ¾ inch to 2 inches per foot with respect to level ground.

4. The apparatus of claim 3 wherein said drive means is adapted to drive said scrubber drum at a speed in the range of 20 – 35 rpm.

5. The apparatus of claim 4 wherein said scrubber unit includes a third scrubber section including a third interior polygonal scrubber which is separated from said second polygonal scrubber chamber by a second retainer ring having an opening therein.

6. The apparatus of claim 5 wherein the opening in said first retainer ring is smaller in area than the opening in said second retainer ring.

7. The apparatus of claim 6 wherein the second polygonal scrubbing chamber has more sides than the first polygonal scrubbing chamber.

8. The apparatus of claim 7 wherein the third polygonal scrubber chamber has more sides than the second polygonal scrubber chamber.

9. The apparatus of claim 8 further including a third retainer ring located between the third scrubber chamber and the output port.

10. The apparatus of claim 9 wherein the first polygonal scrubber chamber has a square cross-section shape; the second polygonal scrubber chamber has a pentagon cross-section shape, and the third polygonal scrubber chamber has an octagon cross-section shape.

11. The apparatus of claim 10 wherein the polygonal scrubber chambers are substantially water-tight on the inside.

12. The apparatus of claim 11 wherein said drive means includes a variable-speed mechanism.

13. The apparatus of claim 12 wherein two of said removable wear plates are held in place by said retainer ring holding plates against each of said sides of said scrubber chambers.

14. The apparatus of claim 2 wherein each scrubber section includes an outer cylindrical shell, a plurality of stiffening members attached thereto and radiating inwardly therefrom, and a plurality of permanent plates attached to said stiffening members in the form of a polygon, said permanent plates as a support for said removable wear plates.

15. The apparatus of claim 1 further including: a means for changing the orientation of one scrubber section relative to another.

16. The apparatus of claim 15 wherein said means for changing the orientation comprises a flange surrounding the periphery of each scrubber section, said flange including holes therein adapted to receive bolts which pass through the corresponding flange in the other scrubber section.

17. A multi-chambered scrubber apparatus comprising:

a frame;

a drive means; and, a scrubber drum attached to said frame and adapted to be rotated by said drive means, said scrubber drum having a material input port and an output port and including between said input and output port at least a first and a second scrubber section each having respectively a first and a second polygonal scrubbing chamber on the interior thereof, said first and said second scrubber chambers being separated by a first retainer ring having an opening therein smaller in area than the cross-section area of said first scrubber chamber, each of said scrubber sections further including a plurality of removable wear plates and a plurality of retainer ring holding plates attached to said retainer ring for holding said wear plates against the interior of said scrubber chambers.

18. A multi-chamber scrubber apparatus comprising:

a frame;

a drive means; and, a scrubber drum attached to said frame and adapted to be rotated by said drive means, said scrubber drum having a material input port and an output port and including between said input and output ports at least a first and a second scrubber section each having respectively a first and a second polygonal scrubbing chamber on the interior thereof, said first and said second polygonal scrubber chambers comprising polygons with a different number of sides.

* * * * *